US009937092B2

(12) United States Patent
Staats

(10) Patent No.: US 9,937,092 B2
(45) Date of Patent: Apr. 10, 2018

(54) DEVICE AND METHODS FOR POSITIONING THE HEAD OF A RECLINING PERSON

(71) Applicant: Sau Lan Tang Staats, Hockessin, DE (US)

(72) Inventor: Sau Lan Tang Staats, Hockessin, DE (US)

( * ) Notice: Subject to any disclaimer, the term of this patent is extended or adjusted under 35 U.S.C. 154(b) by 262 days.

(21) Appl. No.: 14/840,377

(22) Filed: Aug. 31, 2015

(65) Prior Publication Data

US 2016/0051431 A1 Feb. 25, 2016

Related U.S. Application Data

(63) Continuation-in-part of application No. 13/960,797, filed on Aug. 6, 2013, now abandoned.

(51) Int. Cl.
*A61G 7/07* (2006.01)
*A47G 9/10* (2006.01)

(52) U.S. Cl.
CPC ..... *A61G 7/072* (2013.01); *A47G 9/1072* (2013.01); *A47G 9/1081* (2013.01); *A47G 2009/1018* (2013.01)

(58) Field of Classification Search
CPC ..... A47G 9/10; A47G 9/1081; A47C 7/38
USPC ..... 5/630, 632, 633, 636, 640, 643
See application file for complete search history.

(56) References Cited

U.S. PATENT DOCUMENTS 4,393,530 A 7/1983 Stark
4,768,247 A * 9/1988 Beier ..... A47G 9/0253 5/490
4,862,535 A 9/1989 Roberts
5,020,174 A 6/1991 Sarkozi
5,271,114 A * 12/1993 Kjersem ..... A47G 9/0253 5/490
5,272,780 A * 12/1993 Clute ..... A47D 13/08 5/632
6,292,964 B1 9/2001 Rose et al.
6,795,990 B1 9/2004 Hutchinson D. C.
7,100,227 B2 9/2006 Frisbee
8,276,227 B2 * 10/2012 Pileggi ..... A47G 9/1081 5/630

(Continued)

*Primary Examiner* — Eric J Kurilla
(74) *Attorney, Agent, or Firm* — Leason Ellis LLP

(57) ABSTRACT

A method for alleviating the dizziness symptoms of a person suffering from benign paroxysmal positional vertigo comprising the steps of: positioning the head of the person on a head-rest device that is formed of a first pillow structure; a second pillow structure with at least one slanted surface; and a non-permanent fastener on at least one surface of the first pillow structure and one surface of the second pillow structure so that the first and the second pillow can be placed in a user-selected configuration one on top of the other and the relative positions of the first pillow structure to the second pillow structure is fixed by the non-permanent fastener. The second pillow structure overhangs the first pillow structure so as to define an overhang region. The method includes the step of adjusting the second pillow structure so as to position a sleeping surface of the second pillow structure at an angle between about 20 degrees and 60 degrees relative to a horizontal reference surface. The overhang region is configured to receive a head and neck region of the person.

20 Claims, 5 Drawing Sheets

(56) References Cited

U.S. PATENT DOCUMENTS

| | | | | |
|---|---|---|---|---|
| 2005/0229315 | A1 | 10/2005 | Walpin | |
| 2006/0021146 | A1 | 2/2006 | Tokarz | |
| 2008/0028530 | A1 | 2/2008 | Hao | |
| 2009/0056024 | A1 | 3/2009 | Paranjpe et al. | |
| 2012/0073055 | A1 | 3/2012 | Cupo | |
| 2012/0222218 | A1* | 9/2012 | Davis | A47G 9/10 5/490 |
| 2013/0232695 | A1 | 9/2013 | Koci | |
| 2014/0000034 | A1 | 1/2014 | Alexander | |
| 2015/0026891 | A1* | 1/2015 | Davis | A47C 20/021 5/636 |

* cited by examiner

DEVICE AND METHODS FOR POSITIONING THE HEAD OF A RECLINING PERSON

CROSS-REFERENCE TO RELATED APPLICATION

The present application is a continuation-in-part and claims priority to U.S. Non-Provisional patent application Ser. No. 13/960,797, filed Aug. 6, 2013 and currently pending, entitled DEVICE AND METHODS FOR POSITIONING THE HEAD OF A RECLINING PERSON, the entire contents of which is hereby incorporated by reference in its entirety.

TECHNICAL FIELD

The disclosed methods and devices are in the field relating to aiding people affected by motion-induced dizziness. In particular, the disclosed methods and devices relate to the treatment of benign paroxysmal positional vertigo and related diseases with head-maneuvering exercises with the head supported at a range of angles that result in improving the efficacy of home-based self-administered head maneuver exercises substantially

BACKGROUND OF THE INVENTION

Benign Paroxysmal Positional Vertigo (BPPV) or positional vertigo is one of the most common diseases in the United States with a diagnosed population in the millions. It is caused by loose otoliths (ear rocks) falling into the semicircular canals in the inner ear resulting in a disturbed balance. Although not fatal in and of itself, the disease is often extremely debilitating because the dizziness attacks appear to be random, can cause severe nausea, vomiting and unfocused vision, and can interfere with normal daily activities such as driving and eating.

Often, BBPV patients have to lie relatively still in bed for up to several days to minimize the dizziness symptoms. The most common treatments for BBPV are head maneuvering exercises, either carried out at the doctor's office (higher success rate) or self-administered at home (~20% success rate) when symptoms occur, and in extremely severe cases, surgery that may cause complete hearing loss in the affected ear. A large percentage (10-20%) of the patients may have chronic BPPV and are unresponsive at least some of the times to the head maneuver exercises. Medication can have the effect of masking the symptoms, but not eliminating them. As a result, patients' quality of life can be dramatically worsened not only by the unpredictable dizziness episodes causing extreme discomfort, but also by the high anxiety of an unexpected episodic attack disrupting important business deadlines and meetings, long-planned trips, family celebrations, etc.

Conventional head maneuver exercises for BBPV patients, whether administered by a healthcare professional in the clinic, or self-administrated by the patient at home generally have the following attributes in common:

1) the duration of a session of the exercises lasts from several minutes to about 20 minutes;
2) the exercises are carried out in discrete sessions even if the particular exercise is designed to be repeated periodically;
3) the exercises are carried out when the patient has symptoms of BPPV;
4) the exercises include orienting the patient's head in various positions, including having the head lying flat on a flat surface and having the head tilted back hanging over an edge of a bed; and
5) none of the exercises are prescribed for preventive purpose.

Elevating the head while a person is resting or sleeping through the night has been recognized to provide potential wellness benefits to the resting or sleeping person. For example, in the art, it is known that keeping the head elevated during a dizziness episode for patients diagnosed with benign paroxysmal positional vertigo (BPPV) and related diseases caused by conditions in the inner ear may help alleviate dizziness symptoms, and doctors sometimes recommend that patients sleep on a stack of pillows for a night or two. However, the actual head position that is beneficial to BPPV patients is not being elevated so much as being tilted with the top of the head at a higher position than the lower portion of the head. Moreover some head maneuvering exercises repeatedly position the patient's head at certain angles from either horizontal or vertical positions for a short duration of under a minute at each position.

Pillows in the art are typically designed for a particular sleeping position: on the side, on the stomach or on the back based on the degrees of firmness of the pillow. A "well-designed" pillow is said to "cradle" the head so as to conform to the natural position of the user while lying on the bed rather than elevating and tilting the top of the head upward. Stacking two or more pillows together may produce a head rest that may induce large strain to the neck, spine and hip regions and cause pain that may be extremely uncomfortable to the user. Even if the configuration of two or more stacked pillows can be made comfortable for a particular period of time, it would be difficult to maintain that configuration during the usual six to eight hours of sleep time. There are also "wedge" pillows which allow the sleeper to be sleeping on his or her back only so that the user cannot position the head in more than one orientation. Moreover people of different physical builds such as broad versus narrow shoulders, long versus short necks and so forth are forced to use the same-sized pillow designed for the general public such that they must go through different pillows with different firmness to find the pillow or the combination of pillows that fit their physical builds.

It is the object of this application to describe methods of mitigating and preventing BPPV symptoms using a head rest that elevates and tilts the head position of the user during a regular night sleep duration of six to ten hours, allows the user to sleep on the back or the side, provides comfort for users of different physical builds. The methods can also allow the user to choose an optimized configuration and lock in the inclination angle of the head-rest and change the angle to a different one when desired, such as when the severity of the BPPV symptoms demands a steeper angle, or when the absence of BPPV symptoms tolerates a smaller angle of incline that is sufficient to keep the otoliths out of the semi-circular canals and yet provides the least amount of bending of the neck. Since having the head inclined at an angle smaller than about 15°, with respect to the horizontal surface is conducive to having the otoliths fall into the semicircular canals, the disclosed methods and devices disallow the inclined angle to be smaller than about 15° with respect to the horizontal. The methods also disallow the head to tilt backward with respect to the spine position. It is also an objective of the present application to disclose a method to prevent and minimizing the symptoms of motion-induced dizziness in an affected person.

SUMMARY OF THE INVENTION

In one or more implementations, the present application discloses a method of head positioning over a period of time of at least several hours, preferably between two and 10 hours, for preventing the onset of BPPV in a person prone to having BPPV attacks, and for mitigating the BPPV symptoms when a person diagnosed with BPPV is showing the common symptoms of BPPV including motion-induced dizziness, nausea, feeling of stuffiness in the head, etc. In at least one embodiment, the method utilizes a device in the form of a head-rest that enables a user to sleep on his or her side, and on his or her back with comfortable support for the head, neck and shoulder regions, and with his or her head elevated and inclined in a range of inclined angles from about 10 degrees to about 40 degrees with respect to the horizontal. To increase the efficacy of the device for mitigating and preventing BPPV symptoms, the inclined angle ranges from about 20 degrees to about 60 degrees with respect to the horizontal. In other words, the device is constructed to allow the head to rest on a support surface and be inclined at an angle between about 20 degrees and about 60 degrees relative to a horizontal surface on which the device rests. In at least one aspect, the method of head positioning can require a long period of time of practice, at least several hours and up to 10 hours for each session. For this reason, the method is best practiced during the regular hours of daily sleep. In one or more aspects, the present application discloses a device for positioning the head, wherein the device comprises at least two layers which may be separate layers or two distinct portions of a contiguous structure. In a preferred embodiment of the device, the device comprises three layers. The layers are made of a single material or a combination of materials usually used in constructing sleep pillows in the art such as gel fibers, polyester fibers, foams including polyurethane "memory" foam or cut-up foam pieces, beads, buckwheat hulls and other natural materials such as cotton, wool, wood, water fowls' feathers and the like used in the art for stuffing pillows.

In a preferred embodiment, the top layer of the head-support device which provides the sleep surface is made softer than the second layer which provides the support for the top layer. The second layer and the top layer are stacked in such a way that the top layer overhangs and protrudes over the second layer by up to about two-thirds of the width of the top layer, and the width of the overhang, i.e., the amount of the top layer protruding away from the edge of the support layer, is adjustable. The width of the overhang is adjustable by means of fastening devices such as hook and loop devices (e.g., Velcro®), non-permanent adhesive-based devices, hook-and-eye devices, buckles and the like known in the art, or by interlocking means such as grooves and mating ridges, poles and holes, and the like installed on the mating surfaces of the top and second layers.

The length and position of the fastening device can be made so that the relative positions of the first and second layer and the inclined angle created by the top layer on the second layer is at least 15°, and preferably is at least 20° and also about 25 degrees in an alternative embodiment. Indicator means can be used to mark the relative position of the first and second layers so that the inclined angle is preserved for as long as the angle is suitable for minimizing and eliminating the vertigo symptoms. It is undesirable to most users of the disclosed head-support device to use the maximum inclined angle every night as sleeping with the head at a steep angle of larger than 20 degrees to the horizontal may be uncomfortable for the spine and neck regions of the user for more than a few days. For preventive purposes, i.e., the user does not have BPPV symptoms when practicing the disclosed method, the small inclined angle of at least about 20° is effective and relatively comfortable for the user. As the head of the sleeping subject rests on the device, the top layer pivots on the edge of the second layer and the overhanging part of the top layer tips down creating an inclined sleeping surface. The adjustable inclined angle of the sleep surface with the fastening or interlocking devices ensures that the head of a subject of a particular build can be made to tilt at an inclined angle with respect to the horizontal with adequate support for the neck and shoulders for both the on-the-back or on-the-side sleep positions for a prolonged period of time. When the subject sleeps on the back, the head slides down the inclined sleep surface until the neck is comfortably supported by the leading edge of the overhang section, and yet the top of the head is still resting on the part of the top layer closest to the edge of the support layer to prevent the head from resting horizontally or close to horizontally with respect to the surface of the bed.

If the user of the disclosed head-positioning method utilizing the head-rest device suffers from motion-induced dizziness, such as BPPV, and is having symptoms, the head-rest device allows the user to have his or her head inclined at an angle at various orientations during the natural tossing and turning over the head-rest device of over the six to ten hours of sleep. This mimics to a degree some of the head maneuvering exercises that are designed to help relocate the loose otoliths ("ear rocks") out of the semicircular canal or canals of the inner ear, and at the same time, prevents the head from going to the horizontal position which is the most vulnerable position for the otoliths to fall into the semi-circular canal. The angle of incline should be increased from the no-symptom practice to over 30°. The increase of the angle of incline may be increased to about 60°. To achieve the large inclined angle of 60°, a third layer is placed on top of the first top layer and the relative positions of the first and third layer are again secured by fastening means as described above (i.e., adjustable in nature). Since the vertigo symptoms are due to the presence of otoliths in the semi-circular canals, the minimization of the potential of the otoliths falling into the semicircular canals by the use of the disclosed head-positioning methods supported by a head-rest over a long period of several hours may potentially help prevent dizziness symptoms of BPPV.

BRIEF DESCRIPTION OF THE DRAWING FIGURES

The present invention will be understood and appreciated more fully from the following detailed description of preferred embodiments of the present invention, taken in conjunction with the following drawings, of which:

Figure 4:
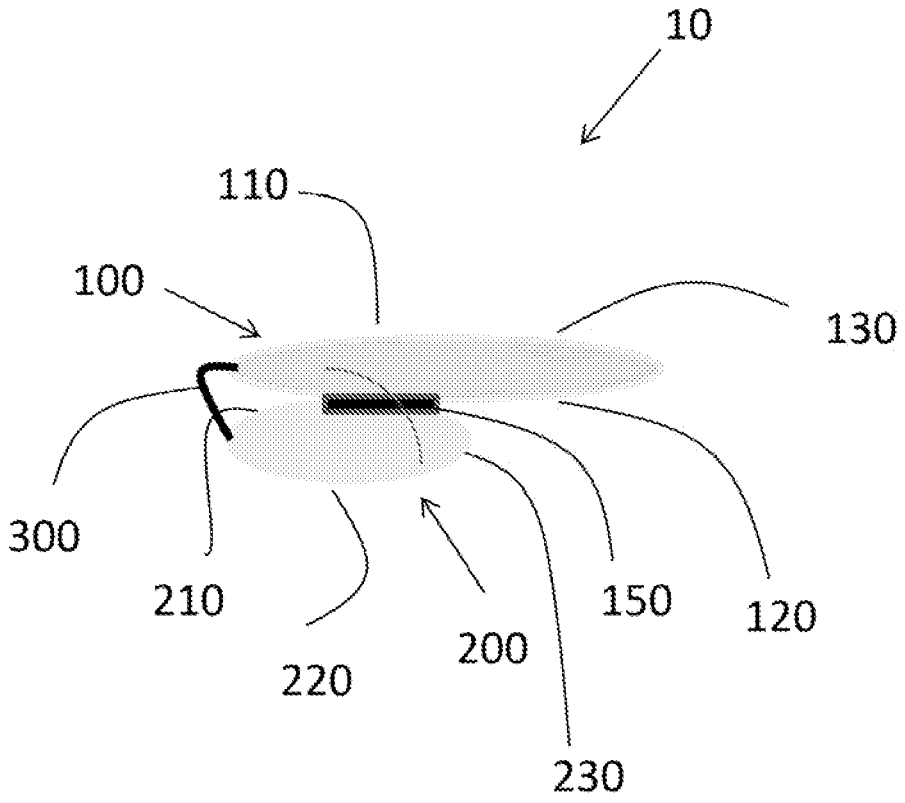
Figure 5:
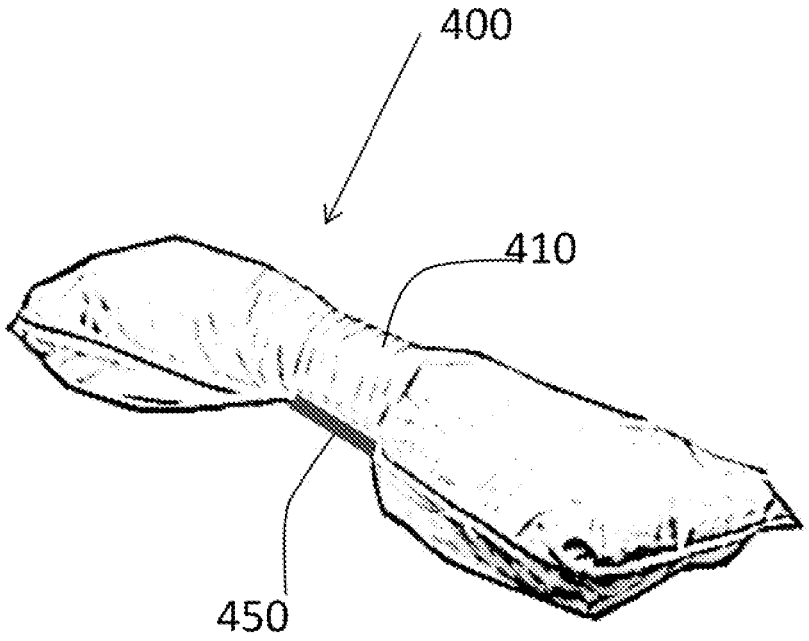

FIG. 4 is a schematic drawing of another embodiment of the disclosed head-rest device comprising the top and the support layers being two distinct portions of a single structure; and FIG. 5 is a schematic drawing of another embodiment of the disclosed head-rest device with a third component which possesses regions of rolled up materials to make the regions firmer and higher than the rest of the component.

DESCRIPTION OF PREFERRED EMBODIMENTS

In at least one aspect, the present application discloses a method to prevent and mitigate the dizziness symptoms of BPPV. According to at least one implementation, at bedtime a person diagnosed with BPPV (herein referred to as the "user"), especially if the person has chronic and recurring BPPV episodes, lays his/her head on an inclined surface of a head-support device, the angle of incline of which is adjustable between about 20° and 60° with respect to the horizontal surface of the bed. The angle of incline is adjusted according to the severity of the vertigo symptoms. When the user does not have on-going vertigo symptoms, the user can use the lowest angle allowed by the head-support device, which is not lower than 15°, and preferably not lower than 20°. When the user has vertigo symptoms that are slight (i.e., the symptoms represent heaviness feelings in the head and some nausea, but no feeling of the outside world spinning or jumping up and down) the angle of incline can be increased from about 20° to about 30° or higher. The angle of incline can be increased to about 60° until the BPPV symptoms are substantially reduced or eliminated. The angle of incline can be lowered down to about 20° once the slight vertigo symptoms disappear.

When the user has severe vertigo symptoms which represent the outside world spinning or jumping up and down, or moving in some directions abruptly and fast, then the angle of incline is increased to as much as about 60°. In a preferred embodiment of the present process, the user moves the position of the head from the sideways position to the on-the-back positions at intervals that are comfortable to the patient. The body of the patient may or may not move with the head as the patient finds a comfortable position to rest the head on the head support. The patient is to practice this process for at least two hours, and preferably for the entire time during the patient's daily sleep.

Figure 1:
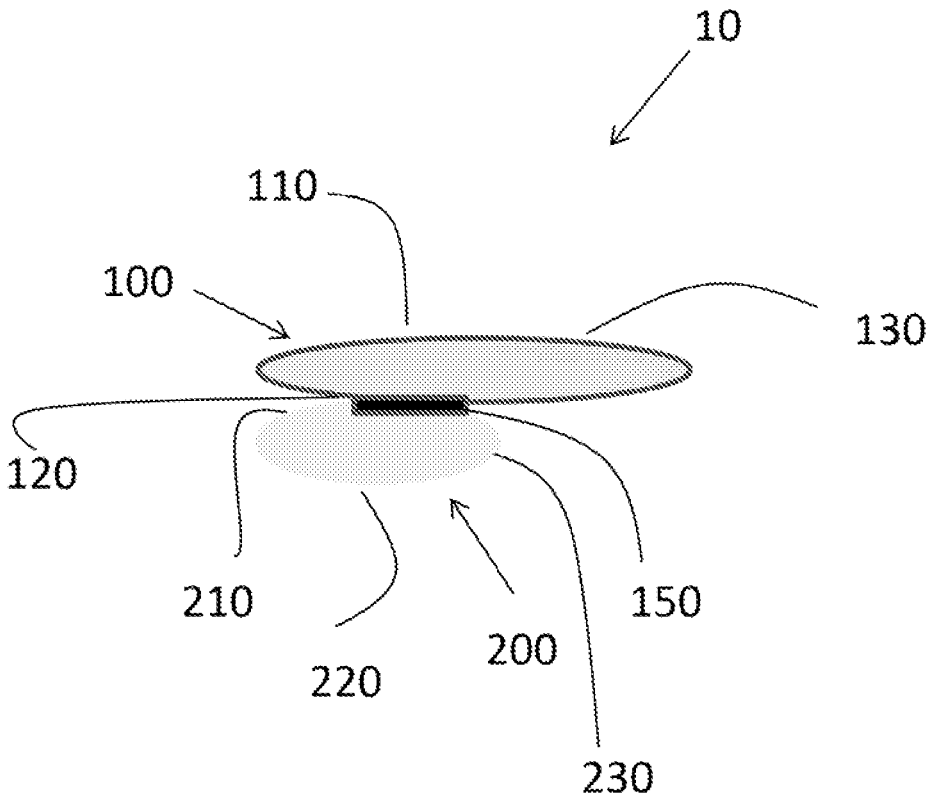
FIG. 1 is a schematic drawing of one embodiment of the disclosed head-rest device comprising two discrete layers.
Figure 2:
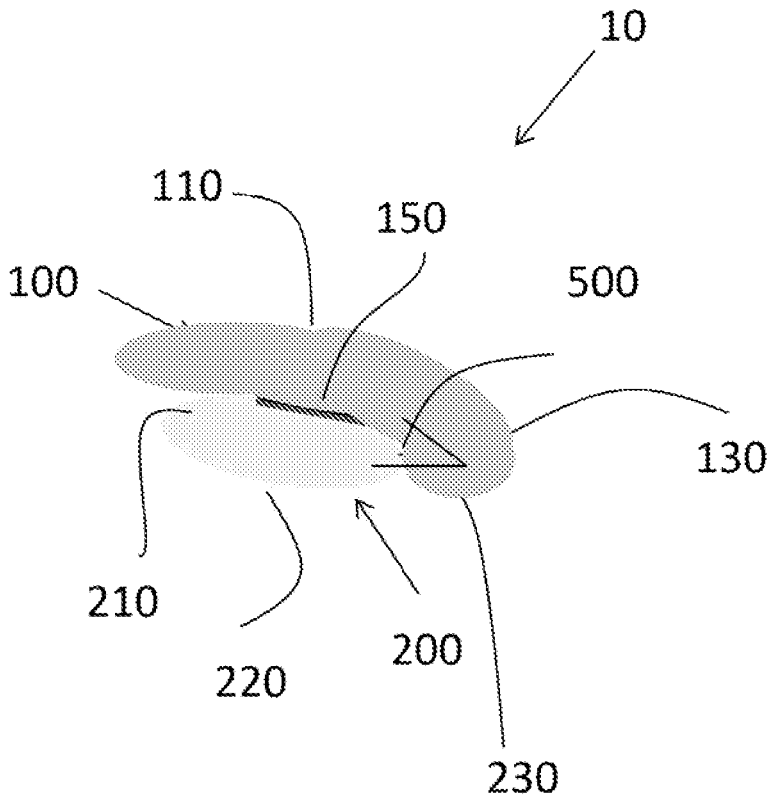
FIG. 2 is a schematic drawing of the approximate configuration of the disclosed device when the head of the user is resting on the device while the user is lying on his or her back.
Figure 3:
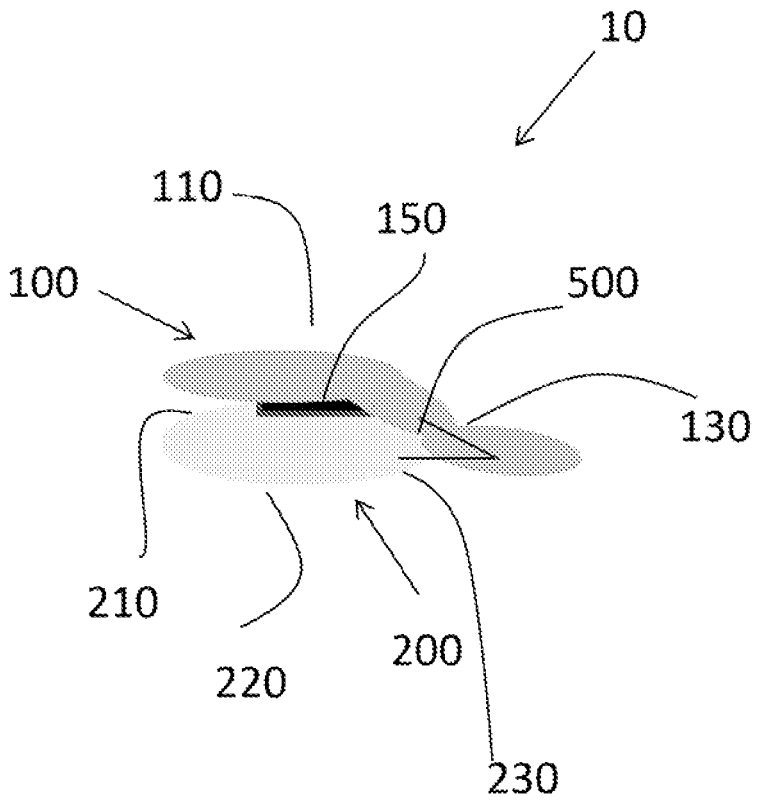
FIG. 3 is a schematic drawing of the configuration of the disclosed device when the head of the user is resting on the device while the user is lying on his or her side.

The head support device used in the present method being disclosed in this invention is a support for the head, neck and shoulders of the user so that the top portion of the head of the user is elevated and at an inclined angle with respect to a more or less horizontal flat surface on which the user lies. Referring to FIG. 1 which shows one embodiment of the head-support device in the invention, the device 10 comprises at least two discrete layers, a top sleeping layer 100 with a first surface 110 and a second surface 120, and a bottom support layer 200 with a first surface 210 and the second surface 220. The second surface 120 of the layer 100 lies partially on top of the first surface 210 of the bottom layer 200. The portion of the layer 100 that juts out from the edge 230 of the layer 200 forms an overhang 130, the width of which when measured from the edge 230 is from about 3 inches to about 15 inches. The total width of the layer 100 is from 14 inches to 25 inches, with the preferred width to be about 20 inches. The length of the layer 100 is in the range of 12 inches to about 40 inches. The layer 200 has a width that is also from about 14 inches to about 25 inches. The preferred width of the layer 200 is about half of the width of the layer 100. The heights of the layers 100 and 200 depend on the materials of which the layers 100 and 200 are made. The layer 100 is made softer than the support layer 200 either by using a softer material for the top layer 100 and a firmer material for the second support layer 200, or by stuffing a casing with sufficient material to make a firm structure for the layer 200, or a combination of both methods. The layer 100 and the layer 200 are shaped by casings made of a textile fabric and stuffed with a material or a combination of materials that are used in stuffing a pillow known in the art. These materials include gel fibers, polymeric fibers such as polyester fibers, polyester fiber clusters, structural foams including polyurethane "memory" foam of various degrees of firmness, cut-up foam pieces, buckwheat hulls, and other natural materials such as cotton, wool, wood, water fowls' feathers and the like. Therefore the layer 100 may be of the form of a conventional pillow made by filling a fabric casing with pillow-stuffing material, or of foam sculptured into a one of the pillow forms known in the art. The preferred materials for making the layer 100 are polymeric fibers, water fowls' feathers, cut-up foams and buckwheat hulls and other non-structural organic or inorganic materials for stuffing a casing. The layer 200 may be made of sculptured foams without sharp edges formed by (approximately) ~90 degrees angles or unstructured materials listed above stuffed in a casing. If unstructured materials stuffed in a casing is used for constructing the layer 200, then the layer 200 should be stuffed to the firmness of a firm or extra firm pillow known in the art. In one embodiment, the surface 210 of the layer 200 is slanted at an angle of about 5 to 10 degrees with respect to the surface 220, and the surface 210 does not have sharp edges. Because of the inclined angle of the surface 210, the preferred height of the layer 200 is about 5 inches on one end of the width and about 4 inches on the other end. On the second surface 120 of the layer 100 and the first surface 210 of the layer 200 are fastening means 150 such as hook and loop devices exemplified by devices under the trademark of Velcro®, non-permanent adhesive strips, hook and eye, buckles, or interlocking structures such as ridges and grooves that fix the position of the layer 100 over the layer 200 so that the width of the overhang 130 can be varied and then once the desired position is achieved, the fastener or interlocking means 150 ensure that the relative position of the layer 100 and the layer 200 is fixed. When the user of the device 10 places his or her head on the sleeping surface 110 of the layer 100 with the overhang region 130 under his or her neck and shoulder regions while lying on his or her side on a flat surface, the weight of the head tips the device 10 so that the sleeping surface 110 forms an incline angle 500 in the range of about 10 degrees to about 40 degrees with the flat surface of the bed, as exemplified in the illustration in FIG. 2. The magnitude of the inclined angle 500 depends on the width of the overhang 130. To achieve this range of inclined angles 500, the height and firmness of the layers 100 and 200 are adjusted which can be carried out effectively by one skilled in the art. The layer 200 should be firm or extra firm as represented by conventional description of the firmness of pillows in the art. For example, to achieve firm or extra firm pillow packing in the art, the weight of the gel fiber used to stuff a standard 20 inches×26 inches standard-sized pillow is from about 20 ounces to over 30 ounces. The overhang 130 supports the neck and the shoulder while the head is mainly supported by the part of the sleeping surface 110 directly over the layer 200 and behind the overhang 130. The leading edge of the overhang 130 may be rolled toward the leading edge 230 of the support layer 200 by the user to gain more height for the head rest and at the same time increases the incline angle. This configuration of the layers 100 and 200 may also be more comfortable for a user with broader shoulders than average. When the user of the device 10 lies on his or her back, the head of the user slides down the inclined sleeping surface 110 until most of user's the head and the neck region rest on the overhang region 130. Only the top portion of the head is supported by the part of the surface 110 wrapping around the edge 230 of the support layer 200, or the distal end of the overhang over the edge 230. By having the lower part of the head resting on the leading edge of overhang region 130, the neck and shoulder regions are much closer to the flat surface of the bed than when the user is lying on his side. The strain on the neck and shoulder regions, as well as on the back of the user is substantially reduced. The incline angle of the head while the user is sleeping on his back and resting the top of the head on the distal end of the overhang 130 of the device may be as small as about 10 degrees.

In another embodiment of the head-support device used in the invention as shown in FIG. 4, the layer 100 and the layer 200 are attached at a connection region 300 such that layer 100 can be folded over to lie one top of layer 200. The relative positions of the layer 100 and the layer 200 are also fixed with fastener or interlocking means as in the previous embodiment. The connection region 300 may be made of a flexible piece of fabric or strap to link the layer 100 and the layer 200 together. As is also known in the art, an additional thin narrow-width cushion strip or foam strip may be used underneath the neck region or the lower back region to give supplemental support while the user is lying on his or her side or his or her back. Likewise additional conventional pillows may be used to provide support on the user's back. In still another embodiment of the device, the additional support is a strip structure that can be rolled up in some parts so that the rolled-up parts provide a firmer and higher support than the rest of the structure. Referring to FIG. 5, the strip structure 400 is about 3 inches high and about 3 to 9 inches wide. The length of the structure 400 may be the same as those of the layer 100 and 200, or longer. The width of the structure 400 may be rolled up in the middle or along the whole length and the rolled-up shape 410 is maintained with the help of non-permanent fastening device 450 such as Velcro® strips. The structure 400 is made of the same kinds of materials as that of the layers 100 and 200. The preferred material for making the strip structure 400 is polyurethane foam with a low impression load deflection (ILD) of about 12. The rolled-up portion of the structure 400 has an ILD larger than the ILD of the foam making up the structure thus enabling the strip structure 400 to have variable heights as well as variable firmness along the length of the structure. The strip structure 400 is not attached to the layer 100 or layer 200 and can be placed under the overhang region 130 to add support for the neck and shoulder region, or placed a portion of the spine for lumbar support.

Because the disclosed method of preventing and mitigating BPPV symptoms correlates the range of severity of the symptoms, i.e., from no symptoms to severe dizziness and the sensation of the external world spinning or jumping to the inclined angle of the user's head during the practice of the method, one embodiment of the head-support device has indicator means (an indicator) 500 to mark the position of the first and second layers and the inclined angle that the first layer 100 and second layer 200 form. The user can then adjust the angle of incline according to whether the BPPV symptoms are getting better or worse. Using the indicator means as the guide, the indicator means 500 can be removable hooks and loops strips that are placed on the top surface 210 of the bottom second layer 200 to conveniently mark the relative position of a particular feature of the first layer 100 as projected on the bottom second layer 200. In particular, the indicator means 500 can set forth the angle of inclination between the two layers on the basis that the user can measure the angle between the two hook and loop strips.

In still another embodiment of the head-support device used in the disclosed method, a third layer 600 which has the attributes of the first layer 100 is used on top of the first layer 100 to achieve the angle of incline of the head-support device to be about 60° in a discrete step. In this embodiment, the third layer 600 is also secured with removable fastening means onto the first layer to fix the relative positions of the first layer 100 and the third layer 600.

In yet another embodiment of the disclosed method, the head of the user is never allowed to be below the axis of the spine of the user to make the neck of the user extended and arched upward.

It is also an objective of the present application to disclose a method for aiding the head maneuvering exercises aimed at alleviating the dizziness symptoms of persons suffering from benign positional dizziness such as BPPV and related diseases. Since the user's head position is always at an inclined angle in the range of 10 to 30 degrees (e.g., 20 degrees and 30 degrees) with respect to the horizontal during the entire night of sleep whether the user is sleeping on his or her side or on his or her back, the head movements of the user during natural tossing and turning mimic to a degree the head-maneuvering exercises used by BPPV patients outside of the clinic to relieve dizziness symptoms. Some exercise includes positioning the head about 45 degrees with respect to the horizontal or vertical and keeping each position for about 20 seconds while a sufferer of BPPV is reclining on a flat surface for a total of about 10 to 20 minutes for each session and about 3 times each day. The user of the disclosed head-rest device positions his or her head at an inclined angle for six to eight hours each night with the head well-supported during the positioning.

The rationale behind positioning the head on the head support to alleviate dizziness symptoms at an inclined angle in the range of 10-35°, and preferably between 20° and 60° (at least about 20-40 degrees) is based on information derived from some published scientific results that show that the horizontal position of the head might be the most vulnerable for the otoliths to enter the semicircular canal. The disclosed process in the invention eliminates the potential that a person diagnosed with BPPV and possesses BPPV symptoms may have his or her head in the horizontal position even during sleep.

Patients who suffer from motion-induced vertigo can attest to the high frequency of episodic attacks occurring in the morning when they get up from the horizontal position. Since having the patient sleep in a recliner or hospital bed arrangement with the upper body and therefore head position at an almost upright position every night is unacceptable to most patients for a variety of reasons, using the disclosed head-rest device in the patient's bed every night or frequently delivers the same benefits.

While the invention has been particularly shown and described with reference to preferred embodiments thereof, it will be understood by those skilled in the art that various changes in form and details may be made therein without departing from the spirit and scope of the invention.

What is claimed is:

1. A method for alleviating the dizziness symptoms of a person suffering from benign paroxysmal positional vertigo comprising the steps of:

positioning the head of the person on a head-rest device comprising:

a first pillow structure;

a second pillow structure with at least one slanted surface;

a non-permanent fastener on at least one surface of the first pillow structure and one surface of the second pillow structure so that the first and the second structures can be placed in a user-selected configuration one on top of the other and the relative positions of the first pillow structure to the second pillow structure is fixed by the non-permanent fastener, wherein the second pillow structure overhangs the first pillow structure so as to define an overhang region, and the overhang region is configured to receive a head and neck region of a person;

preselecting an angle of inclination in the range of 15 degrees to 60 degrees based on the severity of the symptoms of the person, wherein the angle of inclination is measured from the top of the head relative to a horizontal surface upon which the person lies;

adjusting the second pillow structure so as to position a sleeping surface of the second pillow structure at the preselected angle of inclination, wherein the head-rest device does not allow an angle of inclination below 15 degrees; and marking the position of the second pillow structure and the first pillow structure after adjustment of the second pillow structure using an indicator operatively connected to the head-rest device, wherein the indicator is configured to indicate the angle of inclination.

2. The method of claim 1, wherein the indicator comprises a pair of hook and loop strips that are removably attached to the first and second pillow structures.

3. The method of claim 1, wherein the angle of inclination is degrees.

4. The method of claim 1, wherein the angle of inclination is between 20 degrees and 45 degrees.

5. The method of claim 1, where a high point of the slanted surface of the second pillow structure is 5 inches from a base surface of the second pillow structure and a low point of an inclined surface of the first pillow structure is 4 inches from a base surface of the first pillow structure.

6. The method of claim 1, where the second pillow structure is made of a polyurethane foam.

7. The method of claim 1, where the first pillow structure is in the shape of a conventional sleep pillow stuffed to 20-30 ounces firmness with one or more of the pillow-stuffing materials of a discrete nature such as polyester fiber, polyester fiber clusters, cut foam, cotton, wool, beads, grain hulls and the like.

8. The method of claim 1, where the non-permanent fastening means is a hook and loop fastener.

9. The method of claim 1, where the non-permanent fastening means are interlocking structures built into the two interfacing surfaces of the first and second structures.

10. The method of claim 1, further comprising:

orienting the head of the person on the head-rest structure in varying positions while maintaining the preselected angle of inclination, wherein the head of the person is oriented in each position for varying time intervals for a duration of at least one hour.

11. A device for use as a head-rest when a user is reclining on a horizontal surface comprising:

a first three-dimensional pliant component;

a second three-dimensional pliant component that is firmer than the first three-dimensional pliant component, the second three-dimensional pliant component having at least one slanted surface;

a non-permanent fastening means on at least one surface of the first and one surface of the second components so that the first and the second components can be placed in a user-selected configuration one on top of the other and the relative positions of the first component to the second component is fixed by the non-permanent fastening means, wherein the second component overhangs the first component so as to define an overhang region, and the overhang region is configured to receive a head and neck region of a person; wherein the device does not allow an angle of inclination below 15 degrees for the head of the user relative to the horizontal surface.

12. The device in claim 11, where the angle of the slanted surface of the second component is from 5° to 10°.

13. The device in claim 11, where the second component is made of a polyurethane foam.

14. The device in claim 11, where the first component is in the shape of a conventional sleep pillow stuffed to 20-30 ounces firmness, with the first component being made from one or more of the materials selected from the group consisting of: polyester fiber, polyester fiber clusters, cut foam, cotton, wool, beads, grain hulls.

15. The device of claim 11, where the non-permanent fastening means is a hook and loop device.

16. The device of claim 11, where the first and second pliant components are tethered by some flexible means.

17. A method for mitigating vertigo symptoms of a person suffering from benign paroxysmal positional vertigo comprising the steps of: supporting the head of the person on a head-rest structure at an angle of inclination in the range of 15 degrees to 60 degrees, wherein the angle of inclination is measured from the top of the head relative to a horizontal surface upon which the person lies; and switching the head on the head-rest structure between an on-the-back position and a sideways position in response to vertigo symptoms, wherein the head is in the on-the-back position and the sideways position for varying intervals for a duration of two hours to ten hours continuously; wherein the head-rest structure does not allow the head of the person to be supported at an angle lower than 15 degrees with respect to the horizontal surface; wherein the head-rest structure comprises a first portion and a second portion, the first portion being inclined at an angle with respect to the second portion such that the head of the person is supported at an angle in the range of 15 degrees to 60 degrees with respect to the horizontal surface; and the method further comprising: preselecting the angle of the head supported on the head-rest structure within the range of 15 degrees to 60 degrees; attaching the first portion of the head-rest structure to the second portion of the head-rest structure in a desired configuration such that the head of the person is supported at the preselected angle, wherein the first portion is removably attachable to the second portion; and marking the position of the first portion and the second portion in the desired configuration using an indicator to allow the first portion and second portion to be returned to the desired configuration for later use, wherein the indicator is operatively connected to the head-rest structure.

18. The method of 17, wherein the method is performed during the person's daily nocturnal sleep period.

19. The method of claim 17, wherein the first portion and the second portion are removably attached via a non-permanent fastener.

20. The method of claim 19, wherein the non-permanent fastener is a hook and loop fastener.

* * * * *